US005534353A

United States Patent [19]

Kaba et al.

[11] Patent Number: 5,534,353

[45] Date of Patent: Jul. 9, 1996

[54] COMPOSITE SINTERED MATERIAL HAVING FINE PARTICLES OF HARD COMPOUND DISPERSED IN GRAINS OF TITANIUM OR TITANIUM ALLOY MATRIX

[75] Inventors: Takahiro Kaba, Kobe; Takashi Nishi; Tsuyoshi Mitsuhashi, both of Amagasaki, all of Japan

[73] Assignee: Kubota Corporation, Osaka, Japan

[21] Appl. No.: 189,845

[22] Filed: Feb. 1, 1994

[30] Foreign Application Priority Data

Feb. 2, 1993 [JP] Japan ..... 5-039469

[51] Int. Cl.[6] ..... B22F 7/00

[52] U.S. Cl. ..... 428/552; 428/546; 428/551; 428/565; 428/567

[58] Field of Search ..... 428/546, 551, 428/552, 565, 567

[56] References Cited

U.S. PATENT DOCUMENTS 4,731,115 3/1988 Abkowitz ..... 75/236
4,906,430 3/1990 Abkowitz ..... 419/6
4,916,029 4/1990 Nagle ..... 428/614

FOREIGN PATENT DOCUMENTS 3-142053 6/1991 Japan .
4-247801 9/1992 Japan .

*Primary Examiner*—Donald P. Walsh
*Assistant Examiner*—John N. Greaves
*Attorney, Agent, or Firm*—Armstrong, Westerman, Hattori, McLeland & Naughton

[57] ABSTRACT

A composite sintered material of a mixed-phase structure comprising fine particles of hard compound compactly and uniformly dispersed in grains of matrix of titanium or titanium alloy. The material is outstanding in abrasion resistance, strength, toughness, etc., and also has high resistance to corrosion by molten nonferrous metals and is therefore reduced in the likelihood of dissolving out into the melt.

The sintered material is produced by uniformly mixing together a metal powder for forming the matrix of the desired sintered material and a powder for forming particles of hard compound to be dispersed, molding the powder mixture into a block under pressure, atomizing the block while melting the block and sintering the resulting powder.

6 Claims, 2 Drawing Sheets

COMPOSITE SINTERED MATERIAL HAVING FINE PARTICLES OF HARD COMPOUND DISPERSED IN GRAINS OF TITANIUM OR TITANIUM ALLOY MATRIX

FIELD OF THE INVENTION

The present invention relates to composite sintered alloys which are useful as materials for members, such as the components of injection assembly of a die casting machine for nonferrous alloys, of which corrosion resistance, abrasion resistance and high strength are required.

BACKGROUND ART

Alloy tool steels (JIS G4404) for hot dies typical of which is SKD61, and sintered ceramics have heretofore been used as materials for members of injection assemblies of die casting machines which are brought into contact with melts of aluminum, zinc and like nonferrous alloys, for example, for members such as plunger sleeve, piston, tip and gate sleeve.

The injection members made of the above-mentioned alloy tool steel are susceptible to corrosion due to contact with molten aluminum, zinc or like metal. Especially, the plunger sleeve is liable to corrosion and also to abrasion due to repeated sliding movement of the piston, therefore has a short life and requires much care for maintenance. Further rapid corrosion of such members which involves dissolving out of the material into the molten metal to be cast contaminates the melt to impair the quality of the casting.

The injection members made of sintered ceramic material are highly resistant to corrosion and abrasion but have the drawback of being inferior in impact resistance.

Accordingly, composite sintered materials have been proposed which have a mixed-phase structure comprising titanium or titanium alloy and a ceramic which are excellent in corrosion resistance (see, for example, Unexamined Japanese Patent Publications HEI 3-142053 and HEI 4-247801).

However, these composite sintered materials still remain to be improved although being excellent in corrosion resistance and abrasion resistance.

We have found that the insufficient strength of the composite sintered material is attributable to the fact that the microstructure thereof is low in homogeneity and involves uneven presence of ceramic particles as clustered. FIG. 4 shows the structure. The white portions are the metal phase, and the black portions are clusters of fine ceramic particles.

The composite sintered material of titanium-ceramic particles has a mixed-phase structure of low homogeneity because the titanium powder used as a material for sintering is larger in particle size than the ceramic powder mixed therewith as another material. Stated more specifically, the ceramic powder to be used for sintering has extremely small particle sizes of several micrometers (e.g., up to 5 micrometers), whereas titanium powders usually available are as coarse as about 20 to about 30 micrometers if smallest in size. Accordingly, even if the two materials are uniformly mixed together before sintering, the 15 sintered material obtained is in a mixed-phase state in which titanium grains are surrounded by fine ceramic particles.

Referring to FIG. 4 again which shows the mixed-phase structure, it is seen that ceramic particles (black portions) are unevenly present and form a network of clusters along grain boundaries of the titanium phase (approximately equal in grain size to the titanium powder used as the material).

On the other hand, in the case where the ceramic powder used for preparing the mixture to be sintered is generally as coarse as the titanium powder, it is possible to eliminate the uneven presence of ceramic particles in the form of a network of clusters surrounding titanium grains, but the presence of coarse ceramic particles entails the drawback of failing to form a dispersion of improved uniformity and a sintered material of compacted structure.

SUMMARY OF THE INVENTION

An object of the present invention is to provide a composite sintered material of a mixed-phase structure having fine particles of a ceramic compound and/or intermetallic compound (including Laves phase compound) generally uniformly dispersed in grains of matrix metal substantially comprising Ti.

Another object of the present invention is to provide a composite sintered material of a mixed-phase structure having fine particles of a ceramic compound and/or intermetallic compound which are generally uniformly dispersed in grains of matrix metal comprising an alloy of Ti and at least one element selected from the group consisting of Mo, Nb, Ta and V.

Still another object of the invention is to provide a composite sintered material wherein fine particles of TiC and/or ZrC having a particle size of up to about 10 micrometers are generally uniformly dispersed in a volume ratio of about 5% to about 60% in grains of matrix of an alloy comprising 5 to 40 wt. % of Mo and the balance substantially Ti.

DETAILED DESCRIPTION OF THE INVENTION

Figure 1:
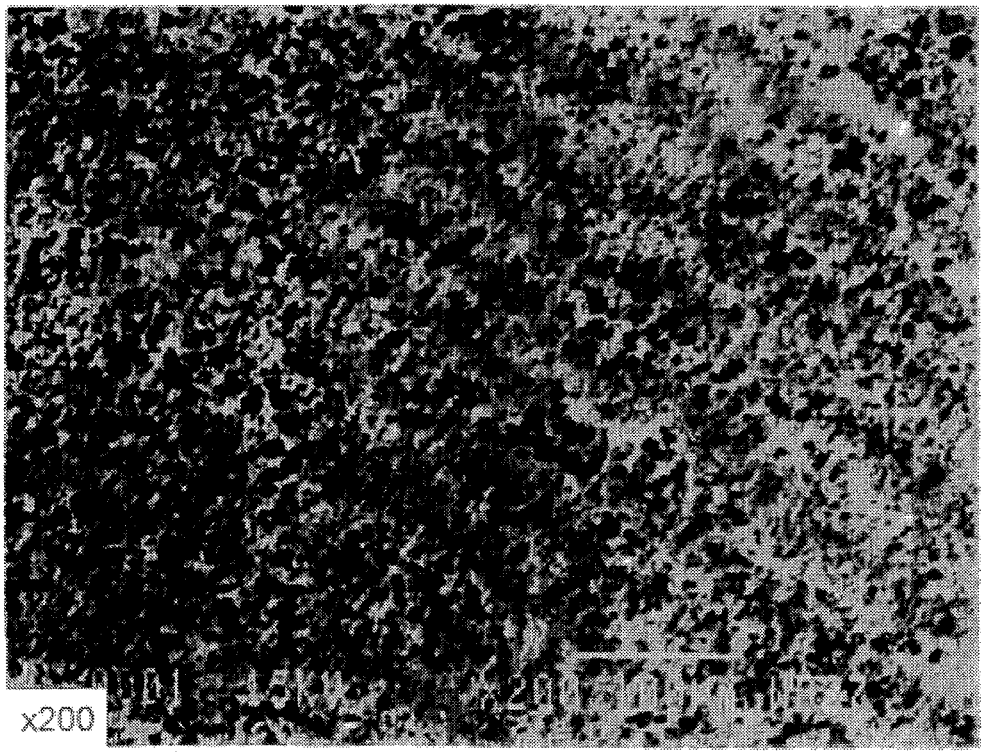
FIG. 1 is a photomicrograph (X200) showing the microstructure of a composite sintered material of the invention.

The composite sintered material of the present invention is characterized by a mixed-phase structure having a matrix of titanium or a titanium alloy containing at least one of Mo, Nb, Ta and V, and fine particles of a hard compound (ceramic compound or intermetallic compound) generally uniformly dispered in grains of the matrix metal.

The composite sintered material of the present invention is produced from a material which is prepared from a metal powder for forming the matrix of the desired sintered material and a powder for forming particles of hard compound to be dispersed, by mixing the powders together uniformly, molding the powder mixture into a block under pressure and making the block into a powder by an atomizing process while melting the block. The resulting powder has fine particles of hard compound separating out within grains of titanium or titanium alloy matrix. The hard compound is generally as small as up to 10 micrometers in particle size and generally uniformly dispersed in the grains.

The powder thus prepared as the material to be sintered has the structure described above, so that the sintered material obtained has a very fine compact mixed-phase structure wherein particles of the hard compound are generally uniformly dispersed in the grains of titanium or titanium alloy matrix. The fine homogeneous mixed-phase structure of dispersion is obtained regardless of the particle size of the powder as prepared by the atomizing treatment.

Ti is a metal having high corrosion resistance and greatly reduced in the likelihood of dissolving out into molten nonferrous metals.

When used in a small amount, the elements Mo, Nb, Ta and V each greatly enhance the abrasion resistance of Ti and also serve to give improved corrosion resistance. Increases in the amount of such elements improve these effects, whereas presence of an excess of the element embrittles the matrix metal and impairs the suitability of the resulting material for use in structural members, so that the amount of the element to be used (combined amount of such elements when at least two of them are used) is preferably up to 40%, more preferably up to 30%. Mo is the most preferable of these elements because this element gives further improved corrosion resistance.

The composite sintered material of the present invention has high corrosion resistance as afforded by the titanium or titanium alloy providing the matrix thereof.

Since the material has a mixed-phase structure wherein fine particles of hard compound are dispersed in the grains of matrix metal unlike the structure of conventional composite sintered materials wherein hard particles are unevenly present to form clusters surrounding a metal phase, the hard particles are dispersed with improved uniformity, giving the present material high abrasion resistance, high strength and outstanding toughness.

Examples of particulate hard compounds useful as the dispersed phase in the matrix metal are carbides (such as TiC, NbC, VC, $Cr_3C_2$, ZrC, WC, TaC, $Mo_2C$ and SIC), borides (such as $TiB_2$, MoB, $Mo_2B$, $ZrB_2$. $HfB_2$, $VB_2$, $NbB_2$, NiB, $TAB_2$, CrB, $CrB_2$ and WB), silicides (such as $MoSi_2$, TiSi2, $ZrSi_2$, $NbSi_2$, $TaSi_2$, $CrSi_2$ and $WSi_2$), nitrides (such as TiN, ZnN, VN, NbN, TaN, $Cr_2N$ and $Si_3N_4$), oxides (such as $Y_2O_3$, $TiO_2$, $ZrO_2$, $Al_2O_3$ and $SiO_2$), intermetallic compounds (such as TiAl and $Ni_3Ti$), Laves phase compounds which are one type of intermetallic compounds (such as $Mo_2Zr$), etc. Such particulate compounds are used singly, or at least two of them may be present in combination.

When highly reactive with titanium, such particulate hard compounds have the drawback that the compound forming element will form a solid solution with the matrix metal to embrittle the resulting material, so that compounds of low reactivity are desirable. From this viewpoint, the hard compound is more preferably TiC, ZrC or $Y_2O_3$, most preferably TiC or ZrC.

For the particulate hard compound to form a dispersion effectively and to thereby fully exhibit an effect to give improved strength, it is desired that the compound be up to 10 micrometers in particle size and occupy at least about 5% of the volume of the mixed-phase structure. The greater the content of the compound, the higher will be the hardness and abrasion resistance of the composite sintered material, but the lower will be the ductility and toughness of the sintered material, so that the upper limit of the volume ratio is about 60%, preferably about 40%. The volume ratio is controlled as desired by adjusting the composition of the metal melt to be subjected to the atomizing treatment.

The composite sintered material of the invention is produced from an atomized powder by sintering in the following manner.

The starting material to be melted for preparing a metal melt for obtaining the atomized powder is prepared by mixing together metal titanium, the element (Mo, Nb, Ta or V) to be made into an alloy with titanium and the component(s) for forming the hard compound, in accordance with the composition of matrix metal of the composite material to be obtained, composition and proportion (volume ratio) of the particulate hard compound to be dispersed, etc.

The components for forming the hard compound are selected in accordance with the composition of the hard compound to be present in the composite sintered material. For example, carbon powder or various carbide powders are usable as components for forming carbide particles, boron powder or various boride powders as components for forming boride particles, silicon powder or various silicide powders as components for forming silicide particles, various oxide powders as components for forming oxide particles, and various nitride powders as components for forming nitride particles. At least two kinds of these powders may be used in combination as desired.

The starting material is melted in the form of a uniform powdery mixture, or in the form of a block of suitable shape prepared from the powder mixture by a suitable pressure molding process (as by cold isostatic pressing) so as to prevent segregation of component in the melting step and obtain a melt of uniform composition.

While the powdery starting material can be melted, for example, by high-frequency melting or plasma arc melting, the plasma arc melting method is advantageous to effect accelerated melting when a high-melting component is used for forming the hard compound.

The melting treatment provides a melt of titanium or titanium alloy containing the hard compound forming element (C, B, Si, N, 0 or the like) and alloy element (Mo, Nb, Ta or V), which is then atomized to obtain a powder.

The atomizing treatment is conducted in the usual method with the exception of using an inert atmosphere to prevent surface oxidation of the powder.

The atomized powder has a mixed-phase structure such that the particles thereof have enclosed therein fine particles of hard compound separating out during the process of atomization and solidification. Regardless of the particle size of the atomized powder, the particles of hard compound are very small (up to about 10 micrometers) and are uniformly distributed in the particles of the powder.

The powder obtained by the atomizing treatment is classified to obtain a fraction of suitable sizes (e.g. up to 500 micrometers), which is then sintered by one of various known processes. For example, the material powder is filled into a capsule, which is then deaerated and closed, followed by hot isostatic pressing for sintering. Alternatively, the material powder is suitably molded under pressure (as by a uniaxial rubber press or cold isostatic press) to obtain a molding, which is then sintered at atmopheric pressure, or hermetically enclosed in a capsule and sintered by hot isostatic pressing. The conditions for the sintering process are not limited specifically. For example, for sintering by hot isostatic pressing, the material is maintained at a temperature of 800°to 1300° C. and increased pressure of 800°to 1300 $kg/cm^2$ for a suitable period of time (for example, for 0.5 to 3 hours).

As entirely distinct from the conventional composite sintered material, the composite sintered alloy thus obtained has a compact mixed-phase structure wherein fine particles of hard compound are uniformly dispersed in the matrix metal without forming any clusters.

EXAMPLE (1) Preparation of powder to be sintered

A powder of metal titanium (up to about 150 micrometers in particle size), molybdenum powder (up to about 10 micrometers) serving as an alloy component of matrix and carbon powder (up to about 10 micrometers) for forming a hard compound were uniformly mixed together in the ratio by weight of 65:25:5, and then subjected to a cold isostatic pressing (CIP) process to prepare a solid cylindrical molding. The molding was melted to obtain a molten alloy, which was then atomized.

Figure 3:
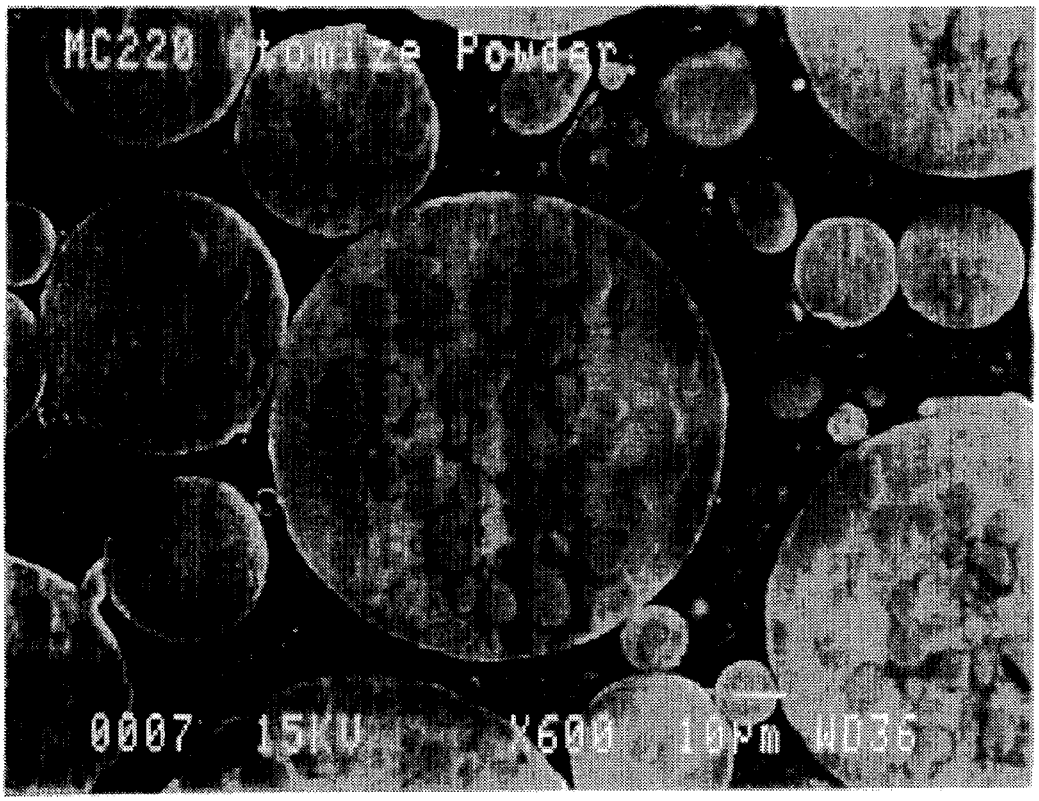
FIG. 3 is a photomicrograph (X600) showing the structure of particulate material to be sintered into the composite material of the invention.

FIG. 3 shows that particles of the atomized powder have a mixed-phase structure (magnification: X600) comprising fine particles enclosed therein. The fine particles are TiC particles produced by the reaction of Ti of metal matrix (Ti—Mo) with carbon.

The atomized powder was classified to obtain a fraction of up to about 500 micrometers in particle size, and the fraction was used as the material to be sintered.

(2) Sintering treatment

The powder obtained by the above atomizing treatment was filled into a steel can, which was then deaerated and sealed off ($10^{-4}$ torr). The powder was thereafter sintered by hot isostatic pressing at a temperature of 1100° C. and pressure of 1100 atm. for 2 hours to obtain a body of composite sintered material (30 mm in diameter and 30 mm in length).

Comparative Example (1) Preparation of powder to be sintered

A titanium powder (lip to about 150 micrometers In particle size), molybdenum powder (up to about 10 micrometers) and TiC powder (up to about 10 micrometers) were mixed together In the ratio by weight of 60:20:20 to obtain a uniform mixture for use as the material to be sintered.

(2) Sintering treatment

The same as in Example.

(A) Comparison in composite mixed-phase structure

Figure 2:
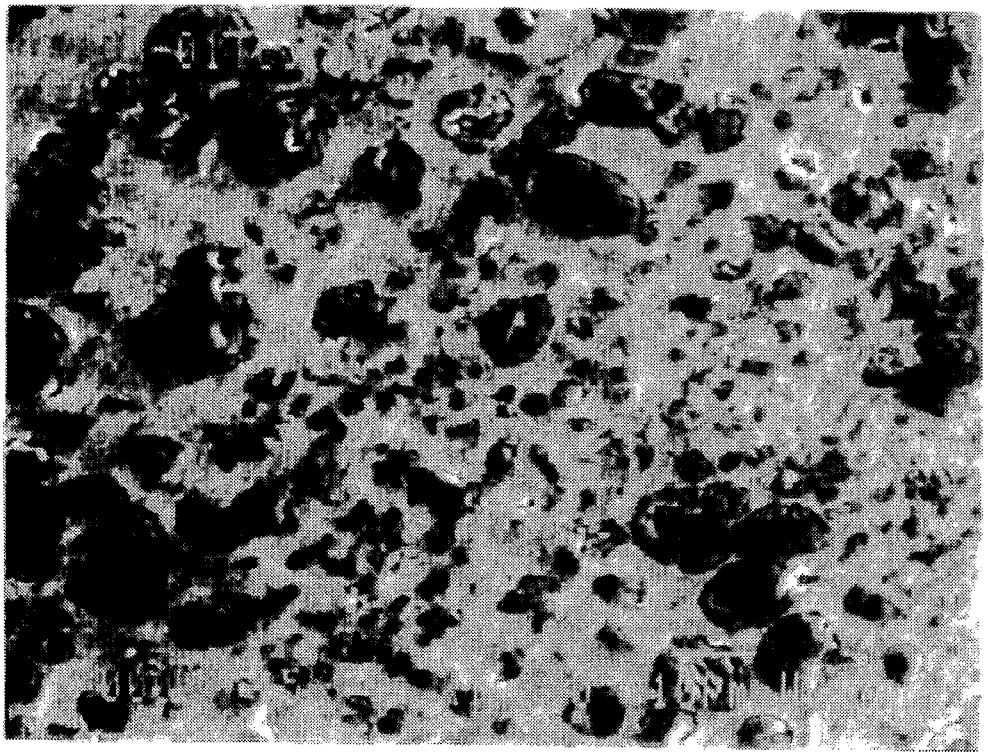
FIG. 2 is a photomicrograph (X1000) showing the structure of the composite sintered material of FIG. 1 on an enlarged scale.
Figure 4:
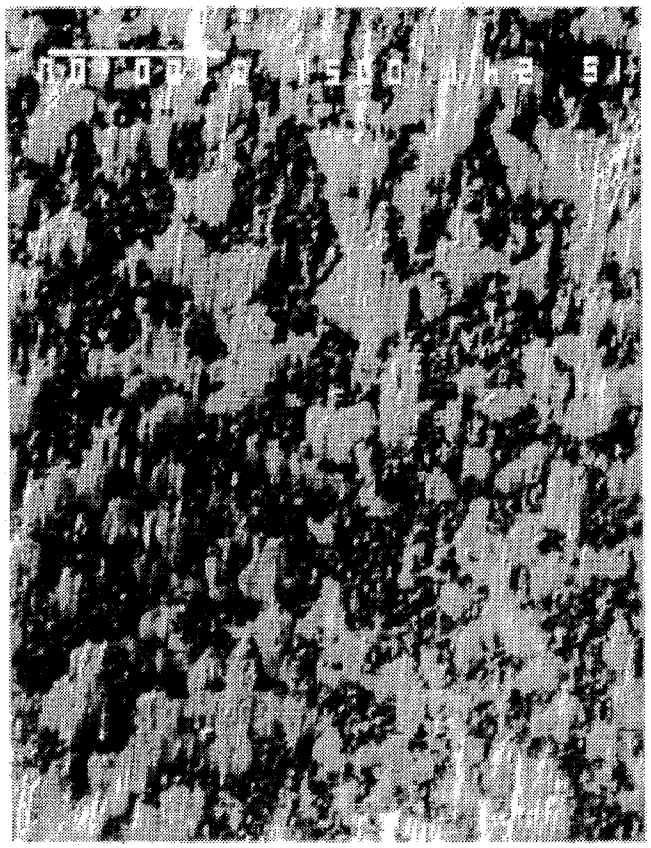
FIG. 4 PRIOR ART
FIG. 4 is a photomicrograph (X200) showing the microstructure of a conventional composite sintered material.

FIG. 1 shows the structure of the sintered body of the invention obtained in Example (X200); FIG. 2, the same structure at an increased magnification (X1000); and FIG. 4, the structure of the composite sintered body (conventional material) obtained in Comparative Example (X200).

In each of the photomicrographs, the white portions are the metal phase (Ti—Mo alloy), and the black portions are ceramic particles of TiC present as a hard compound. The volume ratio of hard particles in each material is about 21%. A comparison between the two materials indicates that with the conventional sintered material, the TiC particles are unevenly present in the structure, as clustered along the grain boundary of the titanium alloy phase, and that the sintered material of the invention has a compacted sintered structure entirely different from this structure and having very fine TiC particles uniformly dispersed therein.

(B) Comparison in properties

Table 1 shows properties of the composite sintered material of the invention and those of the composite sintered material of Comparative Example.

(i) Flexural strength

Determined by the bending test method prescribed in JIS R1601.

Size of test piece: 3×4×50 mm

Span distance: 30 mm

Testing temperature: room temperature (ii) Amount of deflection

The maximum amount of deflection of the test piece subjected to the bending test was measured at the midpoint of the span.

TABLE 1

| | Hardness ($H_{RC}$) | Flexural strength (kg/mm$^2$) | Amount of deflection (mm) |
|---|---|---|---|
| Ex. of invention | 41 | 168 | 0.7 |
| Comp. Ex. | 40 | 115 | 0.5 |

The test results given above reveal that the composite sintered material of the invention is slightly greater in hardness and amount of deflection but exceedingly higher in flexural strength than the comparative material. This improvement is thought attributable to improvements in the homogeneity and fineness of the composite mixed-phase structure.

The composite sintered material of the present invention has a fine mixed-phase structure which comprises fine particles of hard compound as uniformly, compactly dispersed therein. The improvement thus achieved in the mixed-phase structure gives the present material high strength which is exceedingly greater than that of the conventional material. The matrix metal which is titanium or titanium alloy further affords satisfactory corrosion resistance, reducing the likelihood of the present material dissolving out into nonferrous molten metals.

Accordingly, the composite sintered material of the present invention is suited, for example, to use in the components of injection assemblies of die casting machines. The present material is useful also as structural materials for various uses in which corrosion resistance, strength and abrasion resistance are required.

The present invention is not limited to the foregoing description but can be modified variously within the scope as defined in the appended claims.

What is claimed is:

1. A composite sintered material comprising discrete fine particles of TiC and/or ZrC up to about 10 micrometers in particle size and generally uniformly dispersed in a volume ratio of about 5% to about 60% in grains of matrix of an alloy, the alloy consisting essentially of 5 to 40 wt. % of Mo and the balance substantially Ti.

2. A composite sintered material comprising discrete fine particles of rare-earth oxide up to about 10 micrometers in particle size and generally uniformly dispersed in a volume ratio of about 5% to about 60% in grains of matrix of an alloy, the alloy consisting essentially of 5 to 40 wt. % of Mo and the balance substantially Ti.

3. A composite sintered material obtained by generally uniformly mixing together a Ti powder and a powder for forming a hard compound, molding the powder mixture into a block under pressure, subjecting the block to an atomizing treatment while melting the block to prepare a powder comprising discrete fine particles of hard compound uniformly dispersed in grains of titanium metal, and sintering the resulting powder, the composite sintered material being of a mixed-phase structure comprising discrete fine particles of hard compound uniformly dispersed in grains of a matrix metal, the matrix metal consisting essentially of Ti, the particles of hard compound being particles of a ceramic compound and/or an intermetallic compound.

4. A composite sintered material as defined in claim 3 wherein the particles of hard compound are up to about 10 micrometers in particle size and occupy about 5% to about 60% of the volume of the composite material.

5. A composite sintered material obtained by generally uniformly mixing together a Ti powder, a powder of at least one element selected from the group consisting of Mo, Nb, Ta and V for forming an alloy with Ti and a powder for forming a hard compound, molding the powder mixture into a block under pressure, subjecting the block to an atomizing treatment while melting the block to prepare a powder comprising discrete fine particles of hard compound uniformly dispersed in grains of Ti alloy, and sintering the resulting powder, the composite sintered material being of a mixed-phase structure comprising fine particles of hard compound uniformly dispersed in grains of a matrix metal, the matrix metal consisting essentially of more than 0% to up to 40 wt. % of said at least one element selected from the group consisting of Mo, Nb, Ta and V, and the balance substantially Ti, the particles of hard compound being particles of a ceramic compound and/or an intermetallic compound.

6. A composite sintered material as defined in claim 5 wherein the particles of hard compound are up to about 10 micrometers in particle size and occupy about 5% to about 60% of the volume of the composite material.

* * * * *